US010830112B2

(12) United States Patent
Hinz et al.

(10) Patent No.: US 10,830,112 B2
(45) Date of Patent: Nov. 10, 2020

(54) OIL SEPARATION DEVICE FOR THE CRANKCASE VENTILATION OF AN INTERNAL COMBUSTION ENGINE

(71) Applicant: BRUSS SEALING SYSTEMS GMBH, Hoisdorf (DE)

(72) Inventors: Torge Hinz, Hamburg (DE); Mark Dreesen, Hamburg (DE); Samuel Neumann, Ahrensburg (DE); Tino Böttcher, Hamburg (DE); Artur Knaus, Hamburg (DE); Manfred Brand, Tremsbüttel (DE)

(73) Assignee: BRUSS SEALING SYSTEMS GMBH, Hoisdorf (DE)

( * ) Notice: Subject to any disclaimer, the term of this patent is extended or adjusted under 35 U.S.C. 154(b) by 0 days.

(21) Appl. No.: 16/510,158

(22) Filed: Jul. 12, 2019

(65) Prior Publication Data

US 2020/0018202 A1 Jan. 16, 2020

(30) Foreign Application Priority Data

Jul. 13, 2018 (DE) ..... 10 2018 211 760

(51) Int. Cl.
*F01M 13/04* (2006.01)
*F02D 41/00* (2006.01)

(52) U.S. Cl.
CPC ..... *F01M 13/04* (2013.01); *F02D 41/0025* (2013.01); *F01M 2013/0433* (2013.01)

(58) Field of Classification Search
CPC ..... F01M 13/04; F01M 2013/0433; F02D 41/0025; F02D 2250/08
See application file for complete search history.

(56) References Cited

U.S. PATENT DOCUMENTS 5,681,372 A 10/1997 Magits
6,797,040 B2 9/2004 Lenzing
2004/0244783 A1* 12/2004 Ookawa ..... F01M 13/022 123/572

(Continued)

FOREIGN PATENT DOCUMENTS

DE 695 21 980 T2 8/2001
DE 10 2005 017 328 A1 10/2006

(Continued)

OTHER PUBLICATIONS

1st Examination Report issued by the German Patent and Trademark Office dated Jun. 26, 2018 with respect to priority German Patent Application No. 10 2018 211 760.8.

*Primary Examiner* — Jacob M Amick
*Assistant Examiner* — Charles Brauch
(74) *Attorney, Agent, or Firm* — Saliwanchik, Lloyd & Eisenschenk

(57) ABSTRACT

An oil separation device for the crankcase ventilation of an internal combustion engine comprises at least one oil separator with a gas inlet pipe, a gap-determining element, wherein an annular gap is formed or formable between the gap-determining element and an outlet end of the gas inlet pipe, and a baffle wall which is arranged in the flow direction behind the gap. The oil separation device has a driven actuator for adjusting the gap-determining element relative to the gas inlet pipe.

29 Claims, 9 Drawing Sheets

(56) References Cited

U.S. PATENT DOCUMENTS

| | | | | |
|---|---|---|---|---|
| 2007/0256566 | A1* | 11/2007 | Faber | B01D 45/08 96/417 |
| 2009/0199826 | A1 | 8/2009 | Meinig et al. | |
| 2014/0224011 | A1* | 8/2014 | Burlage | G01F 23/0038 73/317 |
| 2016/0138442 | A1* | 5/2016 | An | F01M 13/021 123/559.1 |
| 2017/0167331 | A1* | 6/2017 | Park | F01M 13/04 |

FOREIGN PATENT DOCUMENTS

| | | | | |
|---|---|---|---|---|
| DE | 20 2005 009 990 | U1 | 12/2006 | |
| DE | 100 51 307 | B4 | 7/2008 | |
| DE | 11 2007 003 054 | T5 | 12/2009 | |
| DE | 11 2009 000 550 | T5 | 3/2011 | |
| DE | 10 2014 223 291 | A1 | 5/2016 | |
| DE | 10 2017 001 310 | A1 | 8/2018 | |
| EP | 1 273 335 | B1 | 8/2003 | |
| EP | 1 285 152 | B1 | 2/2004 | |
| EP | 3 192 987 | A1 | 7/2017 | |
| FR | 2852056 | A1 * | 9/2004 | F01M 13/023 |
| WO | WO 2008/085548 | A1 | 7/2008 | |
| WO | WO 2009/126361 | A2 | 10/2009 | |
| WO | WO-2011095633 | A1 * | 8/2011 | B26F 1/384 |
| WO | WO 2016/015976 | A1 | 2/2016 | |

* cited by examiner

OIL SEPARATION DEVICE FOR THE CRANKCASE VENTILATION OF AN INTERNAL COMBUSTION ENGINE

CROSS REFERENCE TO RELATED APPLICATIONS

This application claims priority under 35 U.S.C. § 119(e) of German Patent Application No. DE 10 2018 211 760.8, filed on Jul. 13, 2018, which is incorporated herein by reference in its entirety.

FIELD OF THE INVENTION

The present invention relates to an oil separation device for the crankcase ventilation of an internal combustion engine, comprising at least one oil separator with a gas inlet pipe, a gap-determining element, wherein an annular gap is formed or formable between the gap-determining element and an outlet end of the gas inlet pipe, and a separating chamber with a baffle wall arranged in the flow direction downstream from the gap-determining element.

BACKGROUND OF THE INVENTION

Oil separation devices with a rigid plate which can be displaced against the force of a spring are known for example from DE 100 51 307 B4, EP 1 285 152 B1, and WO 2016/015976 A1.

An oil separation device of the type mentioned above is also known from EP 3 192 987 A1. In this case, the gap between the gap-determining element and the inlet pipe is set depending on the pretension and spring rate of a spring and the back pressure of the flowing blow-by gas. The relevant pressure loss with respect to a certain volume flow is subsequently set. The separator must be designed as a compromise between the existing negative pressure supply, accumulating blow-by gas, and required negative pressure in the crankcase. High negative pressure supplies can therefore not always be exhausted but must be curtailed or throttled with additional components, in particular a pressure control valve, without it being possible to use this potential for a more efficient separation.

Alternatively, electrically driven plate separators are known, see for example EP 1 273 335 B1. It is possible to advantageously control the pressure drop across the separation device with such active separators. However, electrically driven plate separators are complex and therefore costly.

BRIEF SUMMARY OF THE INVENTION

The problem addressed by the invention is to provide a comparatively simple oil separation device with increased separation efficiency and with an improved utilisation of the existing negative pressure supply.

The invention solves this problem with the features of the independent claims.

According to the invention, the separation behaviour of the oil separator and/or the (negative) pressure control can be actively set by the oil separator as desired at any time by the oil separation device comprising a driven actuator for adjusting the gap-determining element relative to the gas inlet pipe. This allows, for example, the oil separation and/or (negative) pressure control to be controlled and/or regulated depending on the engine load, for example also depending on the engine characteristic map, and/or depending on the present and optionally measured pressure ratios.

Active gap control by means of the actuator and an advantageous control device, which regulates the gap depending on a (differential) pressure, e.g. the crankcase pressure or the pressure loss over the oil separation device, considerably increases the effectiveness of the oil separation device in the regions of unused "negative pressure energy". By means of such an advantageous control device, it is also possible to create a characteristic map-controlled crankcase pressure control or implement a characteristic map-controlled pressure drop over the oil separator.

Preferably, the actuator is electrically driven. In a preferred embodiment, the actuator is an electromagnet since it reacts quickly and thus allows for a rapid adjustment or regulation.

Preferably, the actuator adjusts the gap-determining element against the force of a spring. In the idle state, i.e. in the case of an electric actuator in the de-energised state, the spring can hold the gap-determining element in a position with a maximum gap width of the annular gap. In this case, the actuator does not have to be operated when the engine is idling and in low load conditions, which saves energy.

Preferably, the gas inlet pipe is attached to a support fixed to a housing. In this case, an axle or shaft for adjusting the gap-determining element can advantageously be displaceably and/or rotatably mounted in a through-bore of the support. In order to prevent dirt or oil from passing through the through-bore, an annular sealing element is advantageously provided for sealing the axle or shaft against the through-bore.

Advantageously, the actuator is attached to the support. This allows the actuator to be pre-mounted on the support. In particular, the support can be connected to a housing of the oil separation device, in particular inserted or plugged into the housing. The actuator together with the support is then arranged within the housing of the oil separation device in an advantageously protected manner. In this embodiment, electrical contacts, in particular insulation displacement contacts, are particularly advantageously provided on the support and on the housing in each case, the contacts automatically contacting one another as a result of connecting the support to the housing. In this case, the electrical contact for an electric actuator is automatically established in a reliable manner without any further steps.

Preferably, a plurality of oil separators is associated with the or each actuator, the actuator being configured for the simultaneous adjustment of the gap-determining elements of the associated oil separators. In this case, the oil separators associated with an actuator can advantageously be arranged in a ring shape. The plurality of baffle tubes associated with an actuator is preferably held by a baffle tube support and, together with said support, forms a single-piece baffle tube part. The plurality of gap-determining elements associated with an actuator is preferably held by an adjustable support and, together with said support, forms a single-piece adjustment part.

Preferably, the oil separation device has an oil return for returning separated oil into the crankcase. An oil buffer is advantageously arranged in the oil return. Furthermore, a check valve is arranged in the oil return upstream from and/or downstream from the oil buffer. The oil buffer may advantageously have a compressed air connection in order to expel oil from the oil buffer by supplying compressed air to the compressed air connection. In another embodiment, the oil buffer may have a pump port and a membrane connected thereto in order to expel oil from the oil buffer by applying pressure pulsations to the pump port.

Since the pressure losses over the oil separation device can be considerable in some regions and the oil reservoir space is often limited, conventional oil returns, which lead the separated oil back into the crankcase due to built-up hydrostatic pressure, are no longer sufficient. By skillfully dimensioning two combined kickbacks, pulsations at the pump port can be used to pump the oil back. This effect can be amplified with a membrane. Likewise, a targeted pressure surge via the pressure port into the oil buffer is suitable for emptying said buffer.

The invention further provides a system for the crankcase ventilation of an internal combustion engine with a previously described oil separation device and an electronic control device for adjusting, controlling and/or regulating the gap dimension s of the oil separator by means of a corresponding activation of the actuator.

The control device advantageously adjusts, controls and/or regulates the gap dimension depending on the signal from at least one pressure sensor, differential pressure sensor and/or depending on an engine characteristic map. In general, the control device advantageously controls the gap dimension s such that the gap width s is (monotonically) reduced as the engine load increases. In any case, the control device advantageously controls the gap dimension such that, in all operating states of the engine, a negative pressure in the crankcase relative to the atmospheric pressure is ensured to prevent the leakage of harmful gases into the environment under all circumstances.

In a particularly advantageous embodiment, the crankcase ventilation system comprises an ejector connected in series with the oil separation device into the gas stream, which ejector has a propellant gas connection which can be supplied with propellant gas and has a nozzle connected to the propellant gas connection, propellant gas flowing out of the nozzle advantageously promoting the gas flow through the oil separation device. Such an ejector allows for the compensation of pressure losses over the oil separation device, especially at a high engine load level. In this case, a suction port of the ejector can be connected to a gas outlet of the oil separation device (suction arrangement) or a pressure port of the ejector can be connected to a gas inlet of the oil separation device (pressure arrangement).

A short-term abandonment of high separation efficiency and the reduction of the pressure loss to a value that sets a pressure in the clean chamber, which pressure (including the possible hydrostatic pressure gain in the return line) is greater than the pressure in the crankcase, is possible. The arrangement of the ejector can be of importance in this case. Thus, with an upstream ejector (pressure arrangement), the pressure loss can be set so that it is only slightly below the negative pressure gain achieved by the ejector, as a result of which the return condition is then automatically met.

BRIEF DESCRIPTION OF THE FIGURES

The invention will be explained below on the basis of preferred embodiments with reference to the accompanying figures, in which.

DETAILED DESCRIPTION

Figure 1:
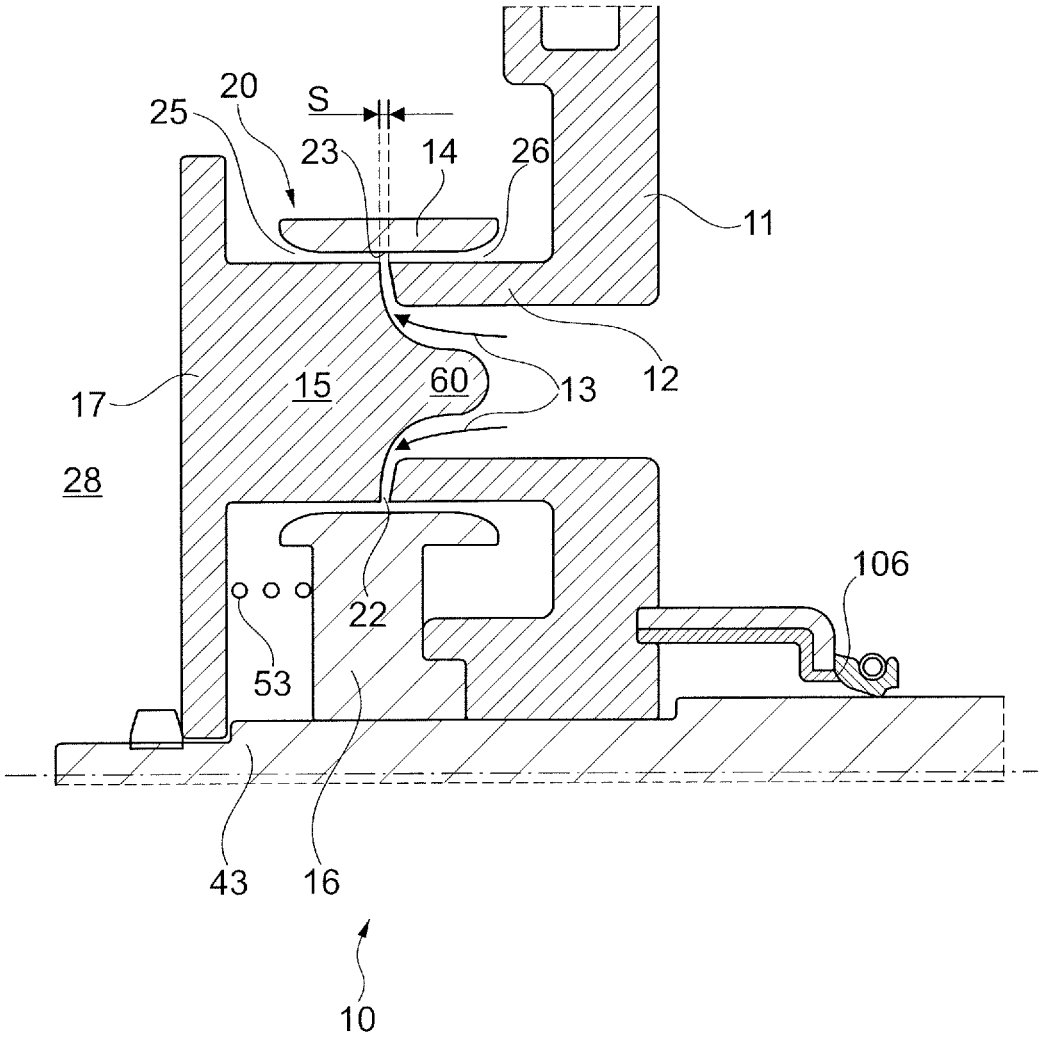
FIG. 1 shows a cross section through an oil separation device in the region of an oil separator.

The schematically shown oil separator device 10 according to FIGS. 1 to 5 comprises one or more annular oil separators 20 which are held on a support 11 fixed to a housing. The support 11 supports at least one gas inlet pipe 12 for blow-by gas 13 from the crankcase ventilation of an internal combustion engine. The oil separation device 10 has at least one adjustable support 17 which forms or supports at least one gap-determining element 15. The support 11, however, is fixed to a housing, that is to say immovably arranged in and with respect to a housing 41 surrounding the oil separation device 10. The housing 41 may be a housing of the oil separation device 10 or a housing of a larger functional unit, such as a cylinder head cover. The adjustable support 17 is adjustable relative to the support 11, which will be explained in more detail.

A baffle tube 14 is associated with each gas inlet pipe 12, which baffle tube has a larger inner diameter than the outer diameter of the associated gas inlet pipe 12 and is arranged with an axial overlap outside and around the associated gas inlet pipe 12 and is thus placed over the associated gas inlet pipe 12 (see FIG. 1).

Figure 2:
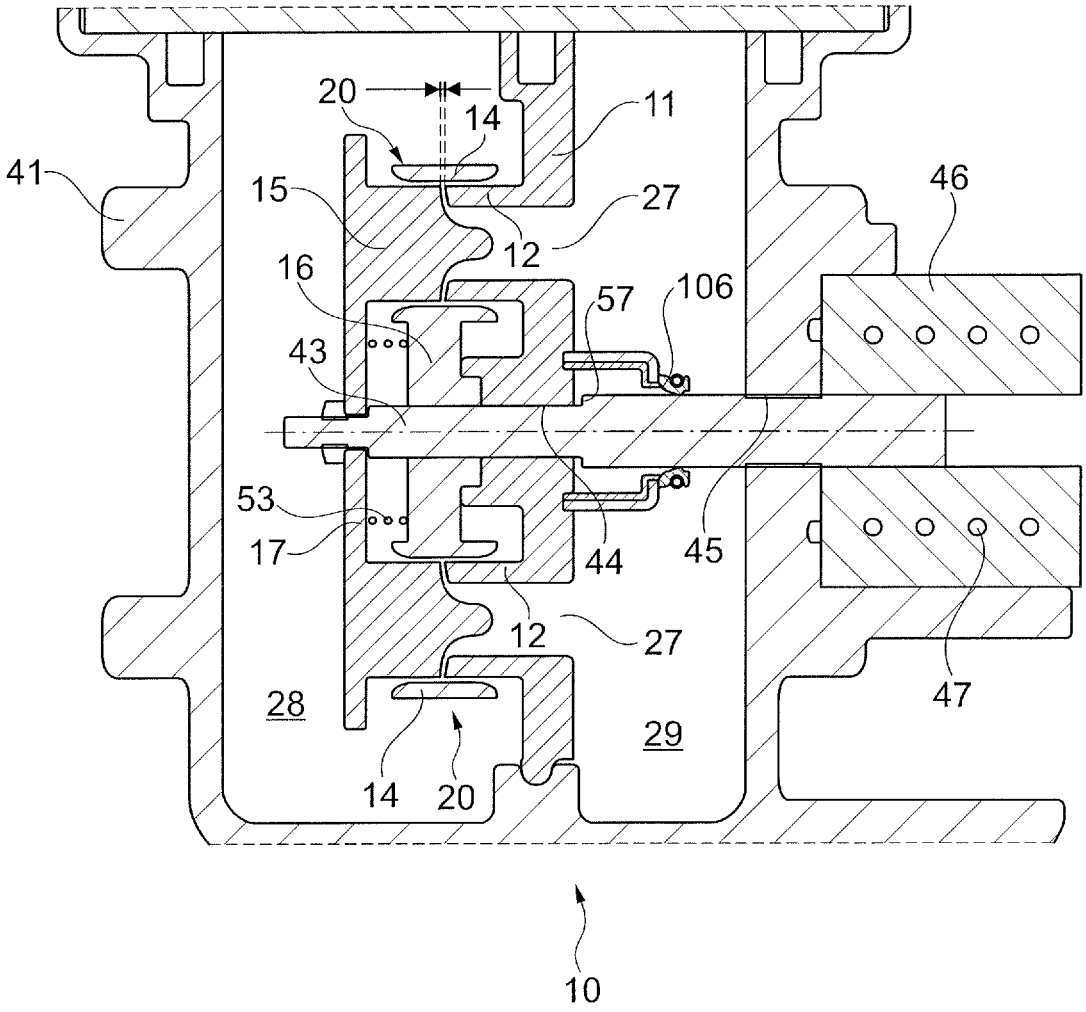
FIG. 2 shows a cross section through an oil separation device.
Figure 5:
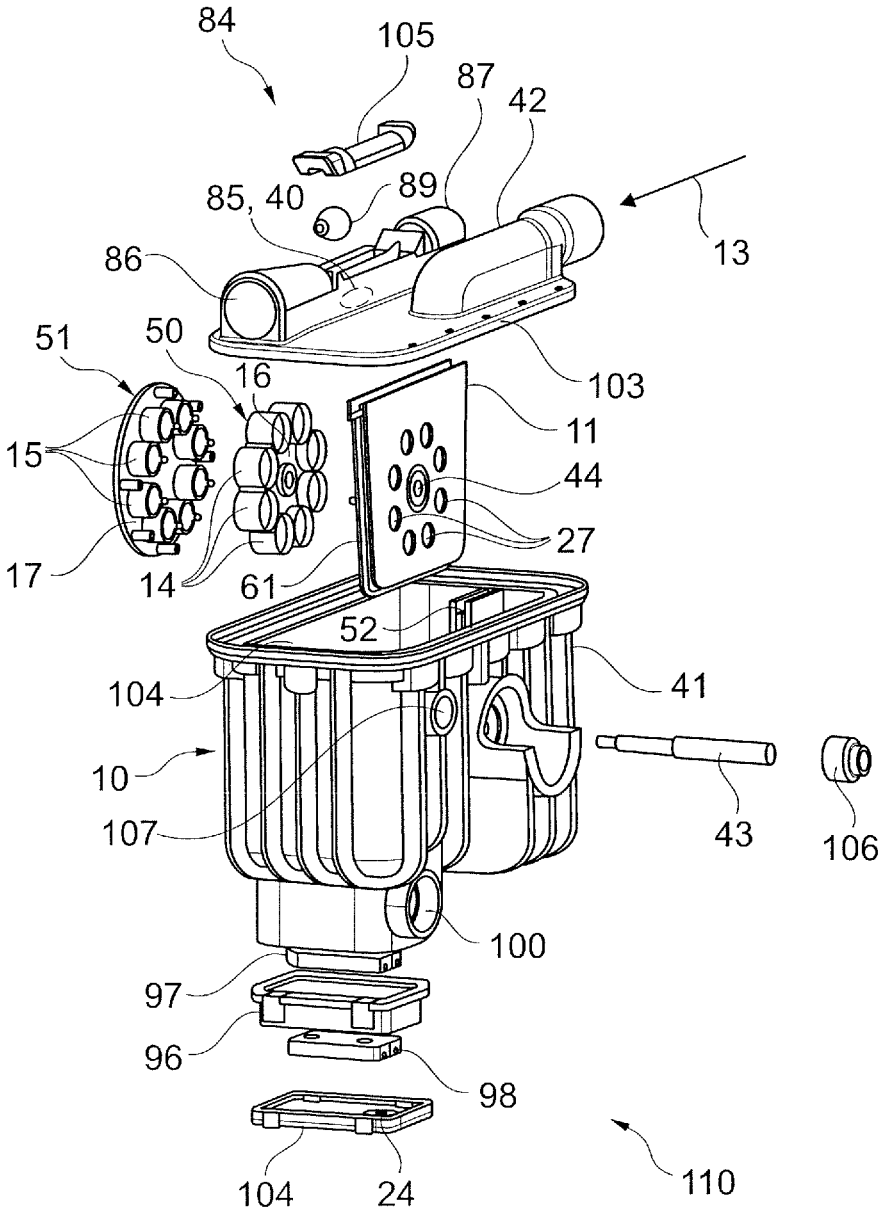
FIG. 5 shows an exploded view of an assembly consisting of an oil separation device and ejector in a suction arrangement.

In one embodiment, the at least one baffle tube 14 is held on or attached to a for example disc-shaped baffle tube support 16 or is integrally formed by a baffle tube support 16, as in FIGS. 1, 2 and 5.

In another embodiment, the at least one baffle tube 14 is integrally formed with the gap-determining element 15 or held thereon or attached thereto (see FIG. 4) and is adjusted together with the gap-determining element 15. In this embodiment, a separate baffle tube support 16 may not be necessary.

A gap-determining element 15 is associated with each baffle tube 14. The outer diameter of the gap-determining element 15 may correspond, for example, to the outer diameter of the gas inlet pipe 12 (see FIG. 1). The outer diameter of the gap-determining element 15 may be smaller than the inner diameter of the associated baffle tube 14 so that the for example pin-shaped gap-determining element 15 may be axially displaceable in the baffle tube 14. The outer shape of the gap-determining element 15 may correspond to the inner shape of the gas inlet pipe 12 and may have a round or circular shape, for example, or alternatively an elliptical or oval shape.

Figure 3:
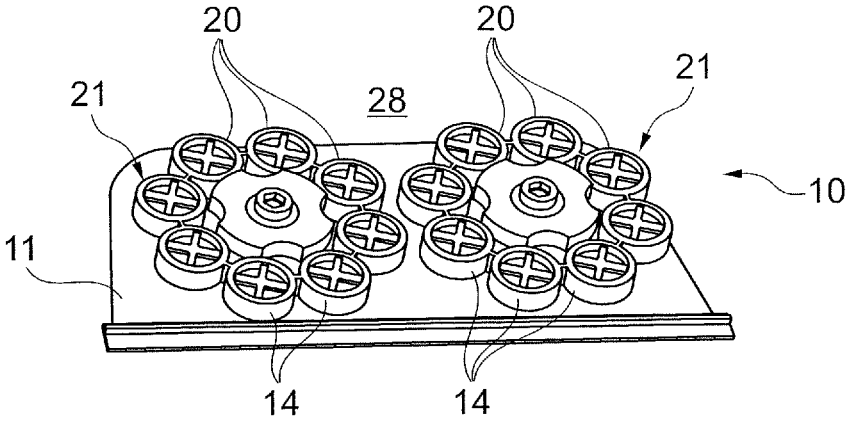
FIG. 3 shows a perspective view of an oil separation device from the clean chamber side.
Figure 4:
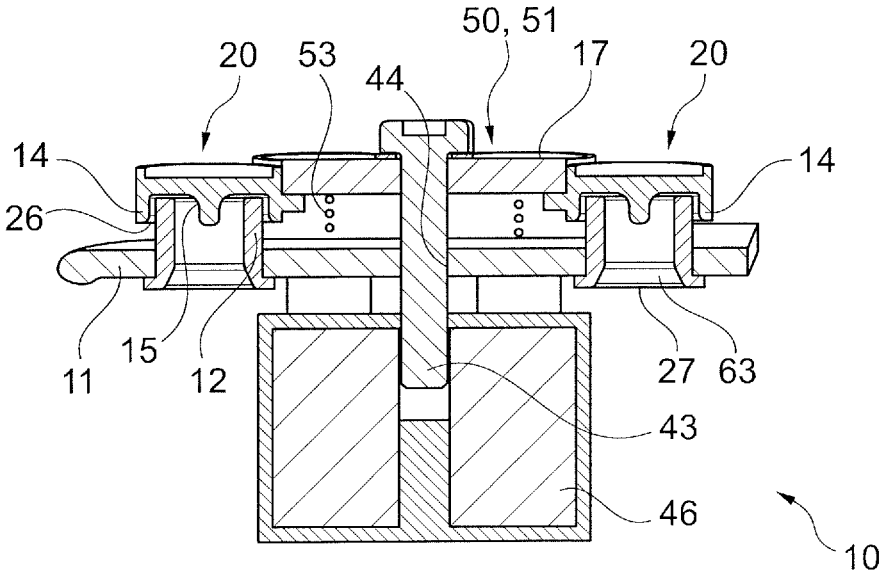
FIG. 4 shows a cross section through the oil separation device from FIG. 3.

In another embodiment according to FIGS. 3 and 4, the gap-determining element 15 covers the gas inlet pipe 12 on the outlet side at the attachment points to the baffle tube 14 and thus has a larger outer diameter than said pipe.

The support 11 and/or the housing 41 consist for example of a plastics material, in particular a reinforced or unreinforced thermoplastic. The support 11 is advantageously arranged as an intermediate wall in the housing 41 and divides the interior of the housing 41 into two spatial regions, namely a pre-separation chamber 29 in the flow direction upstream from the separator(s) 20 and a clean chamber 28 in the flow direction downstream from the separator(s) 20 (see FIG. 2).

The oil separation device 10 may be integrated in a cylinder head cover or an oil separation module. Alternatively, the oil separation device 10 may be a separate component that is connected to other engine components, for example via tubes.

Blow-by gas 13 from the crankcase ventilation is directed into the pre-separation chamber 29 in the interior of the housing 41 via a gas inlet 42 (see FIG. 5). The gap-determining element 15 is supplied with the oil-laden blow-by gas 13 by means of the gas inlet pipe 12. The gap-determining element 15 is arranged at a distance s from the gas inlet pipe 12 such that a gap 22, in particular an annular gap, with a gap width s is formed between the gas inlet pipe 12 and the gap-determining element (see FIG. 1). The oil separator 20 can therefore also be referred to as a gap separator or annular gap separator.

Blow-by gas flows through the gap 22 at high speed and, after exiting the gap 22, encounters the downstream baffle tube 14. A baffle wall 23 is therefore formed by the inner wall of the baffle tube 14. The axial region of the baffle tube 14, which forms the baffle wall 23, is preferably cylindrical. The gas stream exiting through the gap 22 runs approximately perpendicularly to the baffle wall 23 and is deflected sharply at the baffle wall 23. Due to the inertia of the oil and dirt particles in the blow-by gas, these are deposited on the baffle wall 23. The oil deposited on the baffle wall 23 is discharged from the oil separation device through an oil drain opening 24 provided in the housing 41 and returned into the engine oil circuit by gravity via an oil return 94. Due to the annular gap, which circulates completely by 360°, between the baffle tube 14 and the gas inlet pipe 12, a high separation efficiency of each oil separator 20 is created. The oil separator 20 can therefore also be referred to as an annular gap impactor.

The gas inlet into the gap 22 is advantageously rounded. This is achieved, for example, by means of a rounded extension 60 on the gap-determining element 15 which extends into the gas inlet pipe 12 counter to the gas inlet direction (see FIG. 1).

The baffle tube 14 is advantageously arranged concentrically with the gas inlet pipe 12 and, as shown in FIG. 1, with an axial overlap on the outside over the gas inlet pipe 12. Furthermore, the baffle tube 14 is advantageously arranged at a distance from the support 11.

In the embodiment of FIGS. 1 and 2, the baffle tube 14 is open on both sides, whereby a bilateral outflow of the gas stream deflected at the baffle wall 23 is possible. The gas stream deflected at the baffle wall 23 flows on the one side in the same flow direction as through the gas inlet pipe 12 through the corresponding gas outlet opening 25 of the baffle tube 14 and on the other side in the opposite direction through the radial gap between the baffle tube 14 and the gas inlet pipe 12 and through the opposite gas outlet opening 26. Due to the bilateral outflow of the gas stream deflected at the baffle wall 23, the efficiency of the oil separator 20 can be increased compared to known separators. In consideration of the above, both end face openings 25, 26 of the baffle tube 14 are functional gas outlet openings; the gas inlet takes place inside the baffle tube 14 through the gas inlet pipe 12.

In the embodiment according to FIGS. 3 and 4, the baffle tube 14 is completely open on one side and at the other side is otherwise open in the regions outside the connection points to the baffle tube 14. The gas stream deflected at the baffle wall 23 flows in the opposite direction, relative to the flow direction in the gas inlet pipe 12, through the radial gap between the baffle tube 14 and the gas inlet pipe 12 and through the opposite gas outlet opening 26. On the other side, the baffle tube 14 is closed by the gap-determining element 15, which covers the gas inlet pipe 12 and supports the baffle tube 14, in the region of the attachment points to the baffle tube 14. The blow-by gas can also, however, flow in the regions outside the connection points.

In an advantageous embodiment, the separation device 10 has a plurality of separators 20 which are connected in parallel to one another and which are each assigned to the or an actuator 46. The separators 20 may be arranged, for example, in the form of a ring 21 around a central through-bore 44 through the support 11. In the embodiment according to FIG. 3, for example, two groups 21, in each case of eight individual separators 20, assigned to an actuator 46 are provided.

In the embodiment according to FIG. 5, for example, a group 21 of eight individual separators 20 assigned to an actuator 46 is provided. There may be more than two groups 21 and/or more or less than eight individual separators 20 per group 21. The number of individual separators 20 may be the same for all groups 21, as in FIG. 3, or may be different for different groups 21.

Figure 14:
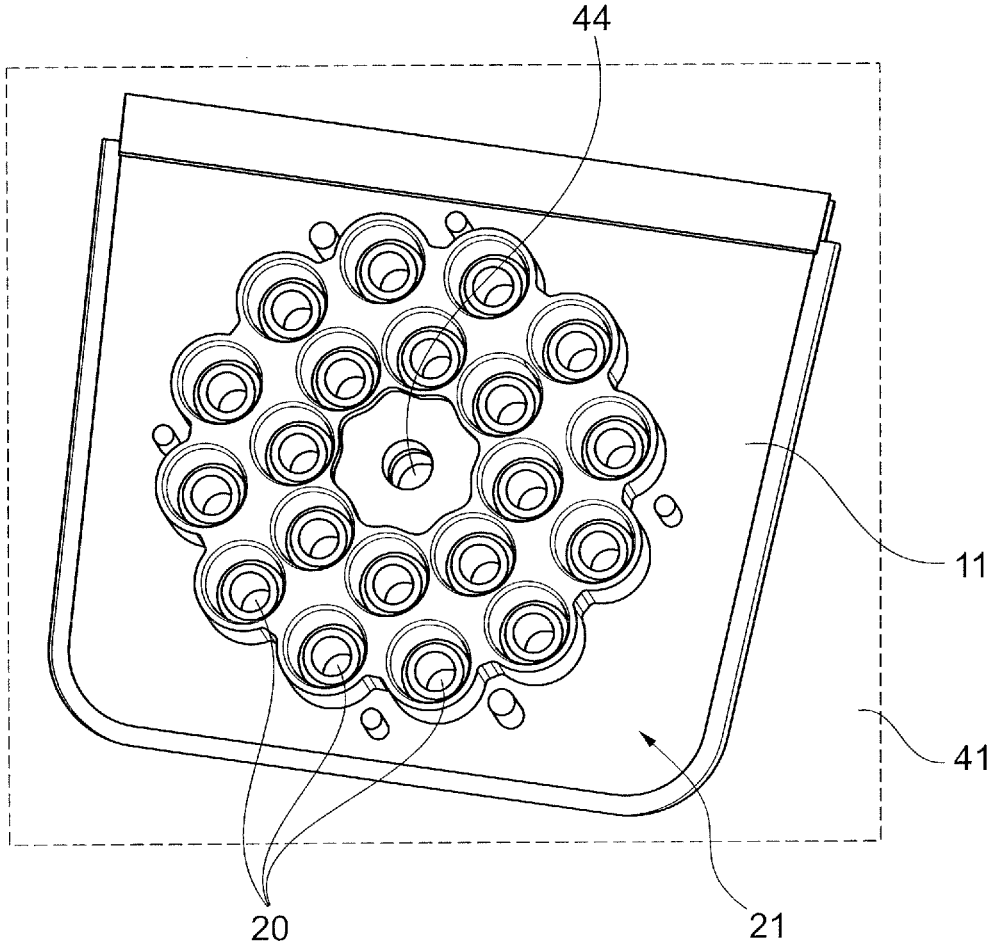
FIG. 14 shows a perspective view of an oil separation device in a further embodiment from the clean chamber side.

In a further advantageous embodiment, which is shown in FIG. 14, a group 21 of more than ten, advantageously more than fifteen, here for example twenty, individual separators 20 is provided. In this case, an inner ring of, for example, eight individual separators 20 and an outer ring with more (for example twelve) individual separators 20 than provided in the inner ring are advantageous, both rings being advantageously arranged concentrically to each other and adjusted by a common actuator 46.

Each individual separator 20 has a gas inlet pipe 12, a baffle tube 14, and a gap-determining element 15. Each group 21 of individual separators 20 thus corresponds to a group of gas inlet pipes 12, a group of baffle tubes 14 (see FIGS. 3 and 5), and a group of gap-determining elements 15 (see FIG. 5). Each separator group 21 is furthermore associated with its own actuator 46, its own axle 43, and its own adjustable support 17.

It is also possible to connect a plurality of groups 21 of individual separators to a common actuator 46. In FIG. 3 for example, both rings 21 of individual separators 20 may be adjustable by a common actuator 46 instead of two actuators.

The group of baffle tubes 14 associated with an actuator 46 is advantageously designed together with the baffle tube support 16 as a single-piece baffle tube part 50 (see FIG. 5) which may be made for example of a thermoplastic material. The group of gap-determining elements 15 associated with an actuator 46 is advantageously designed together with the adjustable support 17 as a single-piece adjustment part 51 which may be made for example of a thermoplastic material. The group of gas inlet pipes 12 associated with an actuator 46 is advantageously designed together with the support 11 as a single-piece component which may be made for example of a thermoplastic material. It is advantageous if the support 11 for the gas inlet pipes 12 and the baffle tube part 50 are separate components because the production of a single-piece component with gas inlet pipes 12 and baffle tubes 14 is difficult due to the small gap dimensions.

The support 11 is substantially planar or wall-shaped and has through-openings 27 which form the inlet openings of the gas inlet pipes 12. On the inlet side, the gas inlet pipe 12 is preferably funnel-shaped and has an inlet funnel 63, the frustoconical inner wall of the gas inlet pipe 12 tapering in the flow direction (see FIG. 4). The gas inlet pipes 12 are advantageously formed as a single piece with and from the support 11. The gas inlet pipes 12 advantageously extend from the support 11 into the clean chamber 28 (see FIG. 3), while the support 11 can be substantially planar towards the pre-separation chamber 29 (see FIGS. 2, 5 and 6).

The gas inlet pipes 12 are advantageously arranged in one or more groups (corresponding to the groups 21 of separators 20) in each case around an associated through-bore 44 through the support 11 for the passage of the corresponding axle 43.

The gap dimension s between the gap-determining element 15 and the gas inlet pipe 12 is actively settable or changeable. For this purpose, the gap-determining element 15 is adjustable relative to the gas inlet pipe 12 or displaceable, in particular axially displaceable, i.e. along the axis defined by the gas inlet pipe 12. This is advantageously effected by axial adjustment of the adjustable support 17 to which the gap-determining element 15 is attached. The axial support 17 is advantageously attached to an axially displaceable axle 43 for this purpose.

Advantageously, the axle 43 is mounted in the separation device 10, more precisely in a through-bore 44 through the support 11, so as to be axially displaceable. One or the bearing point is advantageously formed by a through-bore 44 through the support 11. Another bearing point may be formed by a through-bore 45 through a wall of the housing 41 (see FIG. 2). Advantageously, however, a through-bore 45 through the housing 41 to the outside is dispensed with, and this simplifies the assembly of the separation device 10. The axle 43 is thus advantageously guided by the support 11 from the clean chamber 28, where it is attached to the displaceable support 17, into the pre-separation chamber 29.

In order to prevent dirt or oil from the pre-separation chamber 29 from passing through the through-bore 44 into the clean chamber 28, the axle 43 is preferably sealed against the support 11 by an annular sealing element 106, in particular a sealing ring with a spring-loaded or free (not loaded by a ring spring) sealing lip, in particular made of an elastomer or PTFE (see FIGS. 1, 2 and 5).

The actuator 46 may alternatively be arranged on the other side of the support 11, i.e. on the side of the clean chamber 28. In this case, the through-bore 44 through the support 11 and/or the sealing element 106 may not be necessary.

The axle 43 is adjusted by means of an actuator 46, which is preferably an electromagnet with a coil 47.

The axle 43 is advantageously made of iron, an iron alloy, or other ferromagnetic material and is guided as an anchor or core through the coil 47 of the electromagnet 46. The application of an electric voltage to the coil 47 leads to a flow of current through the coil 47 and, in a manner known per se, to a magnetic force acting on the axle 43 in the axial direction. The electric actuator 46, in particular the current flow through the coil 47, is controlled or regulated by an electronic control device 55 (see FIGS. 8 to 10) in order to set an appropriate gap dimension s depending on the measured negative pressure supply. This will be explained later in more detail.

The actuator 46 may alternatively be an electric motor instead of an electromagnet. In an alternative embodiment that is not shown, a rotatable shaft or axle may be provided instead of the axially displaceable axle 43, the rotational movement of the axle/shaft being converted in a suitable manner, for example with a threaded connection or a drive, into an axial displacement of the displaceable support 17 or the gap-determining element(s) 15.

Figure 6:
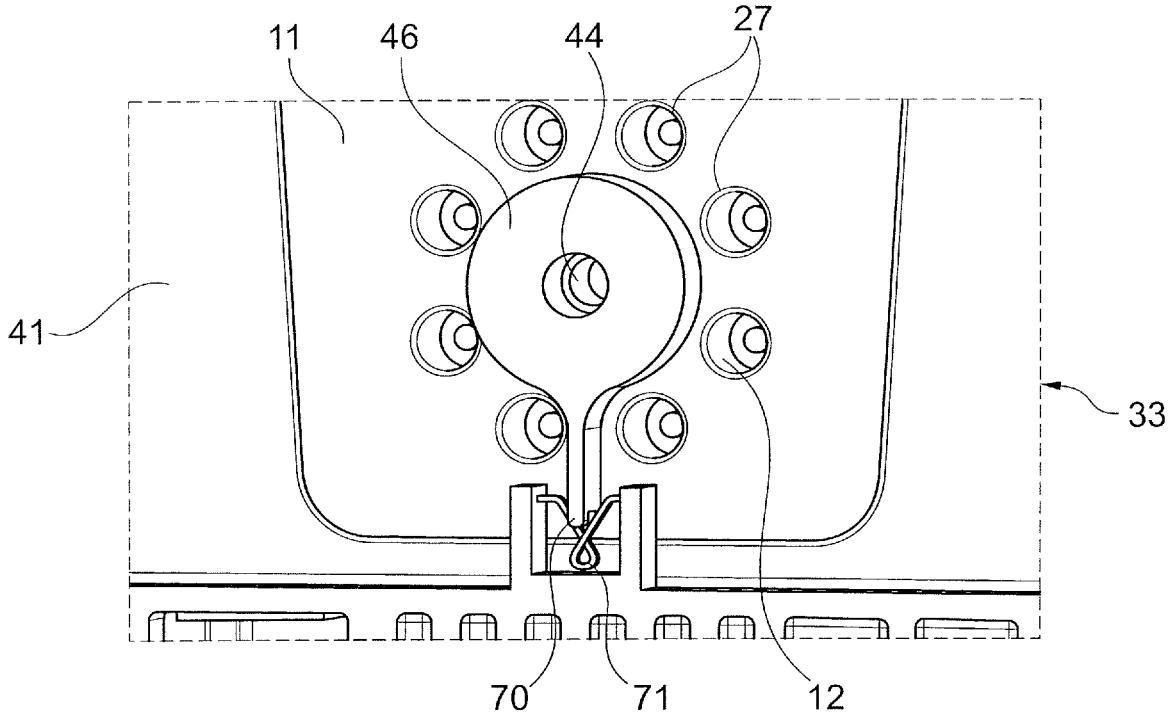
FIG. 6 shows a view of an oil separation device in the region of the actuator from the gas inlet side with insulation displacement contacts.

In a preferred embodiment, the actuator 46 is arranged in the pre-separation chamber 29 of the separation device and is advantageously attached to the support 11, as shown in FIGS. 4 and 6. In another embodiment, in which the axle 43 is guided through the housing 41 to the outside, the actuator 46 may be arranged outside of the housing 41, as shown in FIG. 2.

In the advantageous embodiments in which the actuator 46 is attached to the support 11, the support 11 is advantageously a separate component from the housing 41 and can be plugged or inserted into the housing 41 (see FIGS. 5 and 6) or connected to the housing 41 in any other way. The actuator 46 is first mounted on the support 11, and then the support 11 equipped with the actuator 46 is connected to the housing 41. For this purpose, the housing 41 advantageously has an intermediate wall 32 which, with the inserted support 11, forms a continuous dividing wall 33 between the clean chamber 28 and the pre-separation chamber 29. The dividing wall forming the support 11 may, for example, have projections 61, and the intermediate wall 32 may have grooves 52 into which the projections 61 of the dividing wall 11 can be inserted (see FIG. 5) or vice versa.

In the embodiments described above in which the actuator 46 is premounted onto the support 11 and this is connected to the housing 41, the support 11 advantageously has contacts 70 and the housing 41 advantageously has contacts 71 (see FIG. 6). In the operating state in which the support 11 is connected to the housing 41 so as to be ready for operation, the contacts 70 contact the contacts 71 in order to be able to conduct electrical power to the actuator 46 from an electrical connection (plug or socket; not shown), which is conductively connected to the contacts 71, outside of the housing 41 which is connectable to a power supply of the motor vehicle. The contacts 70, 71 are advantageously designed and arranged such that the contacts 70 come into contact with the contacts 71 without any further steps as a result of the support 11 being plugged or inserted into the housing 41. Particularly advantageously, the contacts 70, 71 may be designed as insulation displacement contacts for this purpose.

Figure 7:
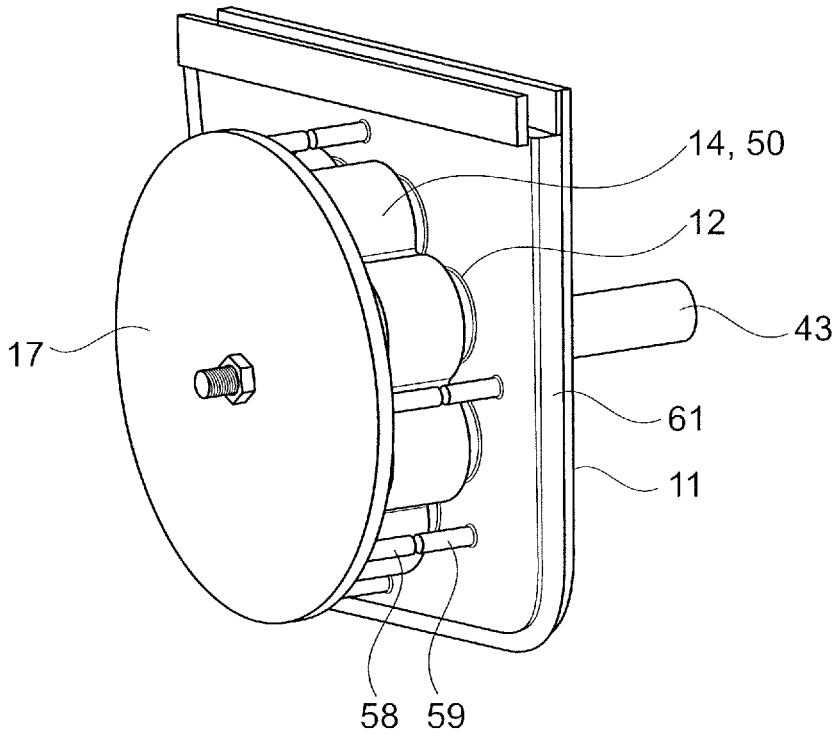
FIG. 7 shows a perspective view of an oil separation device from the clean chamber side.

By means of the actuator 46, the gap dimension s of the oil separator 20 may be set or controlled or regulated within an operating range as desired. This will be explained in more detail in the following. The operating range of the adjustment may be delimited by suitable stops 57, 58 (see FIGS. 2 and 7) on the axle 43, the adjustable support 17 and/or the gap-determining element 15 and/or corresponding stops 59 on parts fixed to the housing, such as the support 11.

The actuator 46 preferably adjusts the adjustable support 17 or the gap-determining element(s) 15 against the force of a spring 53, in particular a helical spring. When the actuator is in the de-energised state, the spring 53 advantageously holds the adjustable support 17 or the gap-determining element(s) 15 in a maximum opened state, i.e. in a state in which the gap width s is at its maximum. This state can be defined by a stop 57 (see FIG. 2). The maximum gap width is selected so that the pressure losses at low negative pressure in the clean chamber 28, i.e. in idle state and low load range, remain low and the pressure in the crankcase 56 remains negative. In general, a larger gap dimension than in the partial and full load range is necessary in the low load range to be able to reliably compensate for pressure losses.

As the engine load increases, the gap dimension s is advantageously reduced in order to achieve a better separation efficiency of the oil separator 20. This is done by controlling or regulating the actuator 46, in this case more precisely the current intensity through the coil 47, by means of an electronic control device 55 of the motor vehicle via a control line 108. As the engine load increases and thus as the negative pressure supply increases, the actuator 46 adjusts the axle 43, the support 17 and the gap-determining elements 15 against the force of the spring 53 (and the applied blow-by gas pressure) in the direction of a reduced gap dimension s, here by increasing the current intensity through the electromagnet 46. In the embodiments of the figures, the actuator 46 draws the support 17 and the gap-determining elements 15 closer in order to reduce the gap dimension s.

The minimum possible gap width s can be zero and can be defined by the contacting abutment of the gap-determining element 15 against the gas inlet pipe 12. The minimum possible gap width s can be greater than zero and defined, for example, by a stop or stops 58, 59 (see FIG. 7).

The control or regulation of the gap dimension s depending on a differential pressure will be explained in more detail below on the basis of FIGS. 8 to 10. In each case, a system 90 for ventilating the crankcase 56 of an internal combustion engine is shown. The oil separation device 10 is generally connected between the crankcase 56 and the intake tract 79 of the internal combustion engine. More specifically, oil-laden blow-by gases 13 are directed through a blow-by line 78 from the crankcase 56 to the oil separation device 10 and introduced via the gas inlet 42 into the pre-separation chamber 29 of the oil separation device 10, are freed therein from liquid components by the at least one oil separator 20, and the purified gas 77 is directed towards the intake tract 79 of the internal combustion engine through a clean gas line 76.

To determine a manipulated or controlled variable, one or more pressures are measured by means of pressure sensors 80, 81, 82 and/or at least one differential pressure is measured by means of at least one differential pressure sensor 83. In particular, a pressure sensor 80 for measuring the pressure in the crankcase 56, a pressure sensor 81 for measuring the atmospheric pressure and/or a pressure sensor 82 for measuring the pressure in the oil separation device 10, in particular in the clean chamber 28, may be provided. In the particularly simple embodiment according to FIG. 10, only one differential pressure sensor 83 is instead provided for measuring the pressure at the gas inlet side of the oil separation device 10 relative to the atmospheric pressure (differential pressure $\Delta p$).

The measurement signals are sent to the electronic control device 55. The electronic control device 55 controls and/or regulates the oil separation device 10 via the control line 108 depending on the measurement signals from the pressure sensor(s) 80-83, for example depending on the pressure in the crankcase 56 or depending on the pressure loss over the oil separation device 10. In particular, the gap dimension s between the gap-determining element 15 and the gas inlet pipe 12 is controlled and/or regulated by adjusting the gap-determining element 15 depending on the negative pressure supply available in the internal combustion engine, as described above.

Pressure losses over the oil separation device 10 can advantageously be compensated for, especially at a high engine load level, via an ejector 84 connected in series with the oil separation device 10 between the crankcase 56 and the intake tract 57. The ejector 84 has a suction port 85, a pressure port 86, and a propellant gas connection 87.

Figure 8:
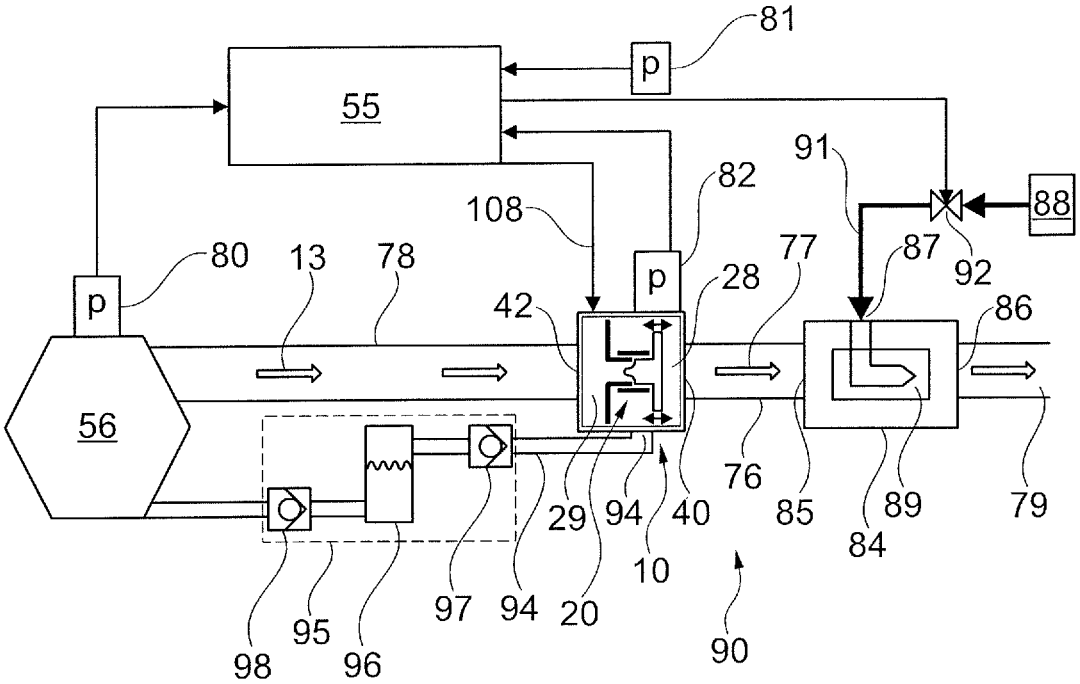
FIG. 8-10 are schematic representations of a system for ventilating the crankcase of an internal combustion engine in different embodiments.
Figure 10:
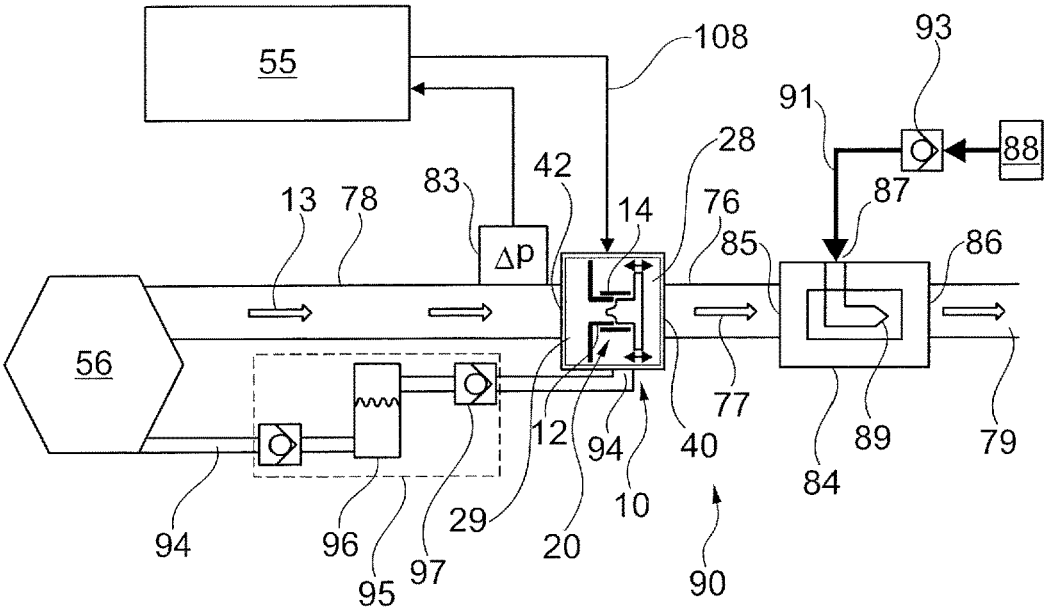

FIGS. 5, 8 and 10 show a suction arrangement of the ejector 84. In this case, the suction port 85 is connected to the gas outlet 40 of the oil separation device 10, through which port the purified gas is discharged from the clean chamber 28 of the oil separation device 10. The pressure port 86 is connected to the intake tract 79 of the internal combustion engine. The ejector 84 is arranged here on the suction side with respect to the oil separation device 10. The oil separation device 10 is connected between the crankcase 56 and the ejector 84.

Figure 9:
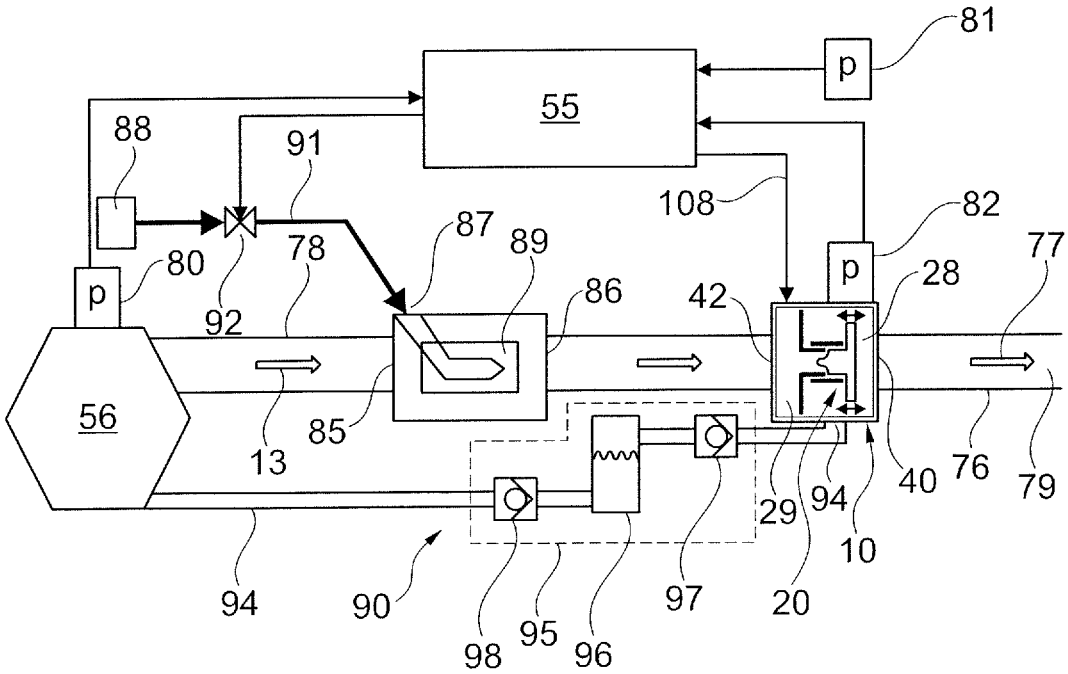

FIG. 9 alternatively shows a pressure arrangement of the ejector 84. In this case, the suction port 85 is connected to the crankcase 56. The pressure port 86 is connected to the gas inlet 42 of the oil separation device 10, through which inlet the blow-by gas 13 flows into the pre-separation chamber 29 of the oil separation device 10. The ejector 84 is arranged here on the pressure side with respect to the oil separation device 10. The ejector 84 is connected between the crankcase 56 and the oil separation device 10.

The propellant gas connection 87 is externally connected via a propellant air line 91 to a compressed air source 88 of the internal combustion engine, for example from the engine charger. The propellant air source provides, for example, a propellant pressure in the range between 0 bar and 2 bar. In the ejector 84, the propellant gas is directed towards a nozzle 89 arranged in the ejector 84 such that the propellant gas discharged from the nozzle 89 at high speed flows and acts in the flow direction of the blow-by gas 13 from the crankcase 56 to the intake tract 79. In this way, the suction effect of the intake tract 79 on the oil separation device 10 is supported, for example (in the suction arrangement) by higher negative pressure at the suction port 40, and correspondingly in the pressure arrangement.

A valve 92 which can be controlled by the electronic control device 55 may be arranged in the propellant air line 91.

The control device 55 can then, in certain operating states of the engine, in particular at high engine load or full load, or depending on the measured pressures or differential pressures, open the valve 92 to supply the propellant air connection 87 of the ejector 84 with compressed air and thus turn on the pump effect of the ejector 84, and in other operating states of the engine, in particular when idling or at partial load, or depending on the measured pressures or differential pressures, close the valve 92 to supply the propellant air connection 87 of the ejector 84 and thus turn off the pump effect of the ejector 84 so that the effect of the ejector 84 is limited to a simple flow tube from the suction port 85 to the pressure port 86.

Embodiments without a controllable valve 92 in the propellant air line 91 are possible; see for example FIG. 10. In these embodiments, the ejector 84 is constantly in a pump state regardless of the operating state of the engine. Since the charge air pressure in the engine charger of zero bar at low engine load usually increases steadily as the engine load increases, in these embodiments there is indirect load control, which has a favourable effect on the separation, since the resulting blow-by gas and the particle concentration contained therein increases as well.

A check valve 93 is then advantageously provided in the propellant air line 91 to avoid a malfunction of the ejector 84 in the reverse flow direction depending on the pressure conditions. In the embodiments of FIGS. 8 and 9, a check valve 93 may also be provided in the propellant air line 91.

In order to be able to reliably return the separated oil into the crankcase 56 over a longer period of time, even at a high separation performance of the oil separation device 10, and to avoid oil backflow into the oil separation device 10, a register arrangement 95 with an oil buffer 96 is advantageously provided in the oil return 94. The inlet to the oil buffer 96 is advantageously arranged at its upper end and provided with a check valve 97, for example in the form of a ball or spring-tongue check valve. The drain from the oil buffer 96 is advantageously arranged at its lower end and provided with a check valve 98, for example in the form of a ball or spring-tongue check valve.

By skillfully dimensioning the check valves, namely a large cross section and small contact surface of the check valve 97 and a small cross section and large contact surface of the check valve 98, pressure pulsations can be exploited to pump oil back into the crankcase 56.

Figure 11:
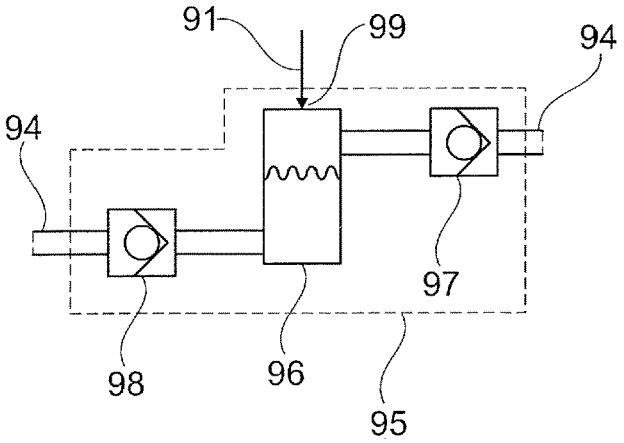
FIG. 11, 12 are schematic representations of register oil returns for an oil separation device in different embodiments.

In the embodiment according to FIG. 11, the oil buffer 96 additionally has a compressed air connection 99 which is connected, for example, to the propellant air line 91 or can otherwise be supplied with compressed air. The oil buffer 96 can be emptied with a targeted pressure surge through the compressed air connection 99.

Figure 12:
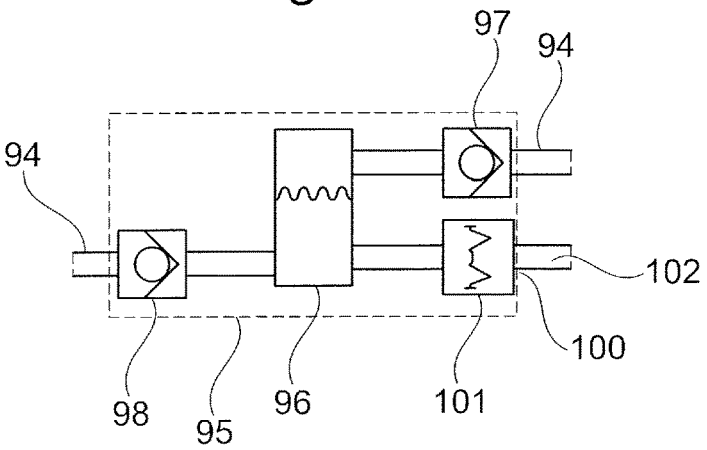

Alternatively, in the embodiment according to FIG. 12, a separate pump port 100 is provided which is connected to a membrane 101. The pump port 100 is connected via a line 102 to a chamber in which pressure pulsations occur when the internal combustion engine is in operation, for example the intake tract 57 or the crankcase 56. The surges exerted on the oil by the membrane 101 as a result of the pressure pulsations also contribute to expelling the oil from the oil buffer 96.

Figure 13:
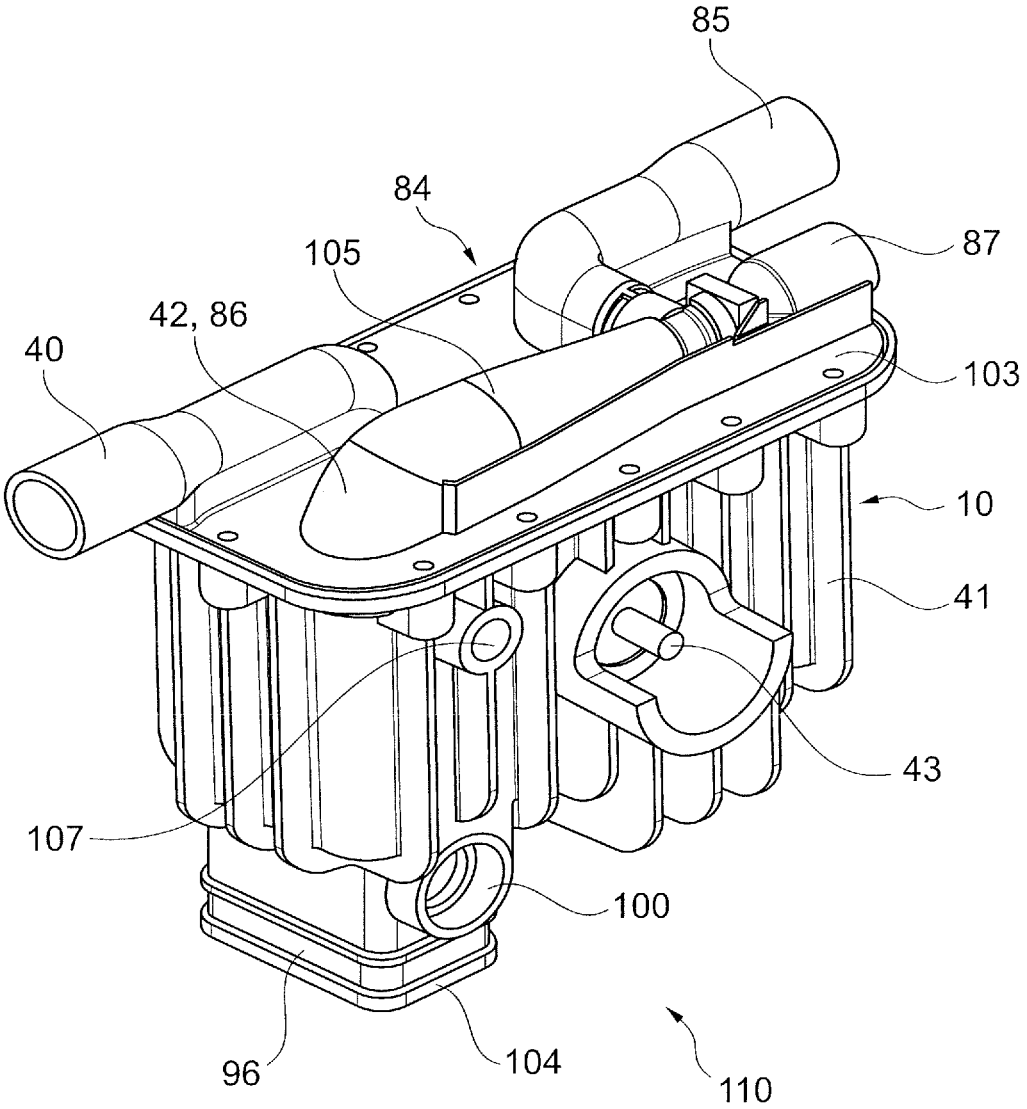
FIG. 13 shows a perspective view of an assembly consisting of an oil separation device and an ejector in the pressure arrangement.

The ejector 84 and/or the register arrangement 95 for the oil return are advantageously integrated in the oil separation device 10 and, together with said device, form an assembly 110 as shown in FIGS. 5 and 13. There, the ejector 84 is advantageously integrated into or non-detachably connected to a lid 103 closing a housing opening 104 of the housing 41. The buffer 96 and a closing cover 104 with the oil drain opening 24 are advantageously designed to form an oil-tight connection to the housing 24. Finally, FIGS. 5 and 13 also show a housing part 105 for covering the nozzle 89 of the ejector 84 and a housing opening 107 for a pressure sensor.

The system 90 advantageously does not require a pressure control valve with a conventional design. Instead, due to the controllability of the gap dimension s, the oil separation device 10 can functionally be regarded as a pressure control valve. However, an additional pressure control valve may be particularly advantageous in spark ignition engines, where very high negative pressures are possible. In this case, the additional pressure control valve can still ensure sufficient negative pressure to the oil separator 10/ejector 84, which pressure can be used for the separation.

EMBODIMENTS

Embodiment 1

Oil separation device (10) for the crankcase ventilation of an internal combustion engine, comprising at least one oil separator (20) with a gas inlet pipe (12), a gap-determining element (15), an annular gap (22) being formed or formable between the gap-determining element (15) and an outlet end of the gas inlet pipe (12), and a baffle wall (23) arranged in the flow direction behind the gap (22), characterised in that the oil separation device (10) has a driven actuator (46) for adjusting the gap-determining element (15) relative to the gas inlet pipe (12).

Embodiment 2

Oil separation device (10) according to embodiment 1, characterised in that the actuator (46) is electrically driven.

Embodiment 3

Oil separation device (10) according to embodiment 2, characterised in that the actuator (46) is an electromagnet.

Embodiment 4

Oil separation device (10) according to any of the preceding embodiments, characterised in that the actuator (46) adjusts the gap-determining element (15) against the force of a spring (53).

Embodiment 5

Oil separation device (10) according to embodiment 4, characterised in that the spring (43) holds the gap-determining element (15) in a position with a maximum gap width of the annular gap when the actuator is in an idle state.

Embodiment 6

Oil separation device (10) according to any of the preceding embodiments, characterised in that the at least one gas inlet pipe (12) is attached to a support (11) fixed to a housing.

Embodiment 7

Oil separation device (10) according to embodiment 6, characterised in that an axle or shaft (43) for adjusting the gap-determining element (15) is displaceably and/or rotatably mounted in a through-bore (44) of the support (11).

Embodiment 8

Oil separation device (10) according to embodiment 7, characterised in that an annular sealing element (106) is provided for sealing the through-bore (44).

Embodiment 9

Oil separation device (10) according to any of embodiments 6 to 8, characterised in that the actuator (46) is attached to the support (11).

Embodiment 10

Oil separation device (10) according to any of embodiments 6 to 9, characterised in that the support (11) can be connected to a housing (41) of the oil separation device, in particular can be inserted or plugged into the housing (41).

Embodiment 11

Oil separation device (10) according to embodiment 10, characterised in that electrical contacts (70, 71), in particular insulation displacement contacts, are provided on the support (11) and on the housing (41) in each case and the contacts (70, 71) automatically contact one another as a result of connecting the support (11) to the housing (41).

Embodiment 12

Oil separation device (10) according to any of the preceding embodiments, characterised in that the actuator (46) is associated with a plurality of oil separators (20) and the actuator (46) is configured for the simultaneous adjustment of the gap-determining elements (15) of the associated oil separators (20).

Embodiment 13

Oil separation device (10) according to embodiment 12, characterised in that the oil separators (20) associated with an actuator (46) are arranged in a ring shape.

Embodiment 14

Oil separation device (10) according to embodiment 12 or 13, characterised in that the plurality of baffle tubes (14) associated with an actuator (46) is held by a baffle tube support (16) and, together with said support, forms a single-piece baffle tube part (50).

Embodiment 15

Oil separation device (10), the plurality of gap-determining elements (15) associated with an actuator (46) being held by an adjustable support (17) and, together with said support, forming a single-piece adjustment part (51).

Embodiment 16

Oil separation device (10) according to any of the preceding embodiments, characterised in that the oil separation device (10) has an oil return (94) for returning separated oil into the crankcase (56).

Embodiment 17

Oil separation device (10) according to embodiment 16, characterised in that an oil buffer (96) is arranged in the oil return (94).

Embodiment 18

Oil separation device (10) according to embodiment 17, characterised in that a check valve (97, 98) is arranged in the oil return (94) upstream from and/or downstream from the oil buffer (96).

Embodiment 19

Oil separation device (10) according to embodiment 17 or 18, characterised in that the oil buffer (96) has a compressed air connection (99) in order to expel oil from the oil buffer (96) by supplying compressed air to the compressed air connection (99).

Embodiment 20

Oil separation device (10) according to embodiment 17 or 18, characterised in that the oil buffer (96) has a pump port (100) and a membrane (101) connected thereto in order to expel oil from the oil buffer (96) by applying pressure pulsations to the pump port (100).

Embodiment 21

System for the crankcase ventilation of an internal combustion engine, comprising an oil separation device (10) according to any of the preceding embodiments and an electronic control device (55) for adjusting, controlling and/or regulating the gap dimension s of the oil separator (20) by means of a corresponding activation of the actuator (46).

Embodiment 22

System according to embodiment 21, characterised in that the control device (55) adjusts, controls and/or regulates the gap dimension s depending on the signal from at least one pressure sensor (80-82), differential pressure sensor (83) and/or depending on an engine characteristic map.

Embodiment 23

System according to embodiment 21 or 22, characterised in that the control device (55) controls the gap dimension s such that the gap width s is reduced as the engine load increases.

Embodiment 24

System according to any of embodiments 21 to 23, characterised in that the control device (55) controls the gap dimension s such that a negative pressure in the crankcase relative to the atmospheric pressure is ensured in all operating states of the engine.

Embodiment 25

System according to any of embodiments 21 to 24, characterised in that an ejector (84) connected in series with the oil separation device (10) into the gas stream is provided with a propellant gas connection (87) which can be supplied with propellant gas and with a nozzle (89) which is connected to the propellant gas connection (87).

Embodiment 26

System according to embodiment 25, characterised in that a suction port (85) of the ejector (84) is connected to a gas outlet (40) of the oil separation device (10).

Embodiment 27

System according to embodiment 25, characterised in that a pressure port (86) of the ejector (84) is connected to a gas inlet (42) of the oil separation device (10).

Embodiment 28

System according to any of embodiments 25 to 27, characterised in that a valve (92) which can be controlled by the control device (55) is provided in a propellant air line (91) which is connected to the propellant air connection (92).

Embodiment 29

System according to any of embodiments 25 to 28, characterised in that a check valve (93) is provided in a propellant air line (91) which is connected to the propellant air connection (92) of the ejector (84).

The invention claimed is:

1. A system for the crankcase ventilation of an internal combustion engine, comprising, an oil separation device wherein the oil separation device comprises:

at least one oil separator, wherein the at least one oil separator comprises:

a corresponding at least one gas inlet pipe;

at least one gap-determining element, wherein a corresponding at least one annular gap is formed or formable between each gap-determining element of the at least one gap-determining element and an outlet end of the corresponding gas inlet pipe of the at least one gas inlet pipe;

a corresponding at least one baffle wall arranged in a flow direction behind the corresponding annular gap of the at least one annular gap;

a driven actuator for adjusting each gap-determining element of the gap-determining element relative to the corresponding gas inlet pipe of the at least one gas inlet pipe; and an electronic control device for adjusting, controlling, and/or regulating a corresponding at least one pap dimension, s, of the at least one oil separator via of a corresponding activation of the driven actuator, wherein the electronic control device adjusts, controls, and/or regulates the at least one pap dimension, s, depending on:

at least one signal from a corresponding at least one pressure sensor;

a signal from a differential pressure sensor; and/or an engine characteristic map.

2. The system according to claim 1, wherein the driven actuator is electrically driven.

3. The system according to claim 2, wherein the driven actuator is an electromagnet.

4. The system according to claim 1, wherein the driven actuator adjusts each gap-determining element of the at least one gap-determining element against a force of a spring.

5. The system according to claim 4, wherein the spring holds the at least one gap-determining element in a corresponding at least one position with a corresponding at least one maximum gap width of the at least one annular gap when the driven actuator is in an idle state.

6. The system according to claim 1, wherein the at least one gas inlet pipe is attached to a support configured to be connected to a housing.

7. The system according to claim 6, wherein an axle or shaft for adjusting the at least one gap-determining element is displaceably and/or rotatably mounted in a through-bore of the support.

8. The system according to claim 7, wherein an annular sealing element is provided for sealing the through-bore.

9. The system according to claim 6, wherein the driven actuator is attached to the support.

10. The system according to claim 6, wherein the support is configured to be connected to a housing of the oil separation device.

11. The system according to claim 10, wherein electrical contacts are provided on the support and on the housing in each case and the electrical contacts automatically contact one another as a result of connecting the support to the housing.

12. The oil system according to claim 1, wherein the at least one oil separator is a plurality of oil separators, and wherein the driven actuator is associated with the plurality of oil separators and the driven actuator is configured for simultaneous adjustment of a corresponding plurality of gap-determining elements of the plurality of oil separators.

13. The system according to claim 12, wherein the plurality of oil separators associated with the driven actuator are arranged in a ring shape.

14. The system according to claim 12, wherein a corresponding plurality of baffle tubes associated with the driven actuator is held by a baffle tube support and, together with the support, forms a single-piece baffle tube part.

15. The system according to claim 12, wherein the plurality of gap-determining elements associated with the driven actuator are held by an adjustable support and, together with the adjustable support, forming a single-piece adjustment part.

16. The system according to claim 1, wherein the oil separation device further comprises:

an oil return for returning separated oil into a crankcase.

17. The system according to claim 16, wherein an oil buffer is arranged in the oil return.

18. The system according to claim 17, wherein a check valve is arranged in the oil return upstream from and/or downstream from the oil buffer.

19. The system according to claim 17, wherein the oil buffer has a compressed air connection in order to expel oil from the oil buffer by supplying compressed air to the compressed air connection.

20. The system according to claim 17, wherein the oil buffer has a pump port and a membrane connected thereto in order to expel oil from the oil buffer by applying pressure pulsations to the pump port.

21. A system for the crankcase ventilation of an internal combustion engine, comprising:

an oil separation device, wherein the oil separation device comprises:

at least one oil separator, wherein the at least one oil separator comprises:

a corresponding at least one gas inlet pipe;

at least one gap-determining element, wherein a corresponding at least one annular gap is formed or formable between each gap-determining element of the at least one gap-determining element and an outlet end of the corresponding gas inlet pipe of the at least one gas inlet pipe; and a corresponding at least one baffle wall arranged in a flow direction behind the corresponding annular gap of the at least one annular gap;

a driven actuator for adjusting each gap-determining element of the gap-determining element relative to the corresponding gas inlet pipe of the at least one gas inlet pipe; and an electronic control device for adjusting, controlling, and/or regulating a corresponding at least one gap dimension, s, of the at least one oil separator via of a corresponding activation of the driven actuator, wherein the control device controls the at least one gap dimension, s, such that the at least one gap dimension, s, is reduced as the engine load increases.

22. A system for the crankcase ventilation of an internal combustion engine, comprising:

an oil separation device, wherein the oil separation device comprises:

at least one oil separator, wherein the at least one oil separator comprises:

a corresponding at least one gas inlet pipe;

at least one gap-determining element, wherein a corresponding at least one annular gap is formed or formable between each gap-determining element of the at least one gap-determining element and an outlet end of the corresponding gas inlet pipe of the at least one gas inlet pipe; and a corresponding at least one baffle wall arranged in a flow direction behind the corresponding annular gap of the at least one annular gap;

a driven actuator for adjusting each cap-determining element of the gap-determining element relative to the corresponding gas inlet pipe of the at least one gas inlet pipe; and an electronic control device for adjusting, controlling, and/or regulating a corresponding at least one gap dimensions, s, of the at least one oil separator via of a corresponding activation of the driven actuator, wherein the control device controls the at least one gap dimension, s, such that a negative pressure in the crankcase relative to the atmospheric pressure is ensured in all operating states of the engine.

23. The system according to claim 1, wherein an ejector connected in series with the oil separation device into the gas stream is provided with a propellant gas connection which can be supplied with propellant gas and with a nozzle which is connected to the propellant gas connection.

24. The system according to claim 23, wherein a suction port of the ejector is connected to a gas outlet of the oil separation device.

25. The system according to claim 23, wherein a pressure port of the ejector is connected to a gas inlet of the oil separation device.

26. The system according to claim 23, wherein a valve which is configured to be controlled by the control device is provided in a propellant air line which is connected to the propellant air connection.

27. The system according to claim 23, wherein a check valve is provided in a propellant air line which is connected to the propellant air connection of the ejector.

28. The system according to claim 21, wherein the driven actuator adjusts each gap-determining element of the at least one gap-determining element against a force of a spring.

29. The system according to claim 22, wherein the driven actuator adjusts each gap-determining element of the at least one gap-determining element against a force of a spring.

* * * * *